US010844604B2

(12) United States Patent
Folkersen et al.

(10) Patent No.: US 10,844,604 B2
(45) Date of Patent: Nov. 24, 2020

(54) FIELD SHINGLE LAYOUT MARKS ON ROOF DRIP EDGE

(71) Applicant: Roofers' Advantage Products, LLC, E. Wakefield, NH (US)

(72) Inventors: Jonny E Folkersen, E. Wakefield, NH (US); Benjamin J Folkersen, New Port Richey, FL (US)

(73) Assignee: Roofers Advantage Products, LLC, E. Wakefield, NH (US)

( * ) Notice: Subject to any disclaimer, the term of this patent is extended or adjusted under 35 U.S.C. 154(b) by 0 days.

(21) Appl. No.: 15/983,893

(22) Filed: May 18, 2018

(65) Prior Publication Data

US 2018/0347199 A1 Dec. 6, 2018

Related U.S. Application Data

(60) Provisional application No. 62/515,817, filed on Jun. 6, 2017.

(51) Int. Cl.
*E04D 13/158* (2006.01)
*E04D 13/04* (2006.01)
*E04D 15/02* (2006.01)

(52) U.S. Cl.
CPC ..... *E04D 13/158* (2013.01); *E04D 13/0459* (2013.01); *E04D 15/025* (2013.01); *E04D 2013/0468* (2013.01)

(58) Field of Classification Search
CPC ..... E04D 13/158; E04D 13/0459; E04D 2013/0468; E04D 15/025
See application file for complete search history.

(56) References Cited

U.S. PATENT DOCUMENTS 2,669,950 A * 2/1954 Bartholomew ..... E04D 13/076 52/12
3,192,670 A * 7/1965 Jones, III ..... E04D 13/15 52/95
4,081,657 A * 3/1978 Stanford ..... E04D 13/103 219/213
4,254,594 A * 3/1981 Hammond ..... E04D 13/064 52/11
4,385,010 A * 5/1983 Bosne ..... F28F 25/04 261/110
4,594,820 A * 6/1986 Render ..... E04D 13/15 52/60
5,170,597 A * 12/1992 Stearns ..... E04D 13/0459 52/11
5,251,411 A * 10/1993 Kelley ..... E04D 13/064 156/290
5,272,846 A * 12/1993 Kelley ..... E04D 13/064 52/300
5,414,965 A * 5/1995 Kelley ..... E04D 13/064 52/60
5,893,247 A * 4/1999 Hickman ..... E04F 19/02 52/300

(Continued)

OTHER PUBLICATIONS

Office Action for Canadian Appl. No. 3,007,235, dated Jul. 16, 2020, 4 Pages.

*Primary Examiner* — Rodney Mintz
(74) *Attorney, Agent, or Firm* — Maine Cernota & Rardin

(57) ABSTRACT

A method and system for aligning shingles on a roof using alignment marks placed directly on drip edges, limiting the need for stand-alone measurement devices.

18 Claims, 5 Drawing Sheets

(56) References Cited

U.S. PATENT DOCUMENTS 5,894,697 A * 4/1999 Hunter ..... E04D 13/02 52/254
6,035,587 A * 3/2000 Dressler ..... E04D 13/0459 52/716.2
6,511,741 B1 1/2003 Hungarter
6,523,275 B2 2/2003 Medford
6,725,617 B2 * 4/2004 Cox ..... E04B 5/10 52/302.6
7,150,128 B2 * 12/2006 Schuman ..... E04B 5/12 52/105
7,617,613 B2 * 11/2009 Merryfield, Jr. ..... B44D 3/38 33/414
8,281,521 B1 * 10/2012 Rasmussen ..... E04D 13/0459 52/60
8,739,470 B1 * 6/2014 Wayne ..... E04D 13/15 52/58
9,540,817 B2 * 1/2017 Folkersen ..... E04D 1/26
10,041,253 B2 * 8/2018 Folkersen ..... E04D 1/26
10,077,558 B2 * 9/2018 Heo ..... E04D 13/0459
10,132,085 B2 * 11/2018 Bredeweg ..... E04D 13/158
10,465,387 B2 * 11/2019 Anthony ..... E04D 13/076
2001/0034954 A1 * 11/2001 Medford ..... E04D 15/025 33/759
2003/0056445 A1 * 3/2003 Cox ..... E04B 5/10 52/62
2003/0079431 A1 * 5/2003 Schuman ..... E04B 5/12 52/506.01
2003/0154664 A1 * 8/2003 Beck ..... E04D 3/32 52/105
2005/0005551 A1 * 1/2005 Graham ..... E04D 13/0459 52/415
2007/0074466 A1 * 4/2007 Rasmussen ..... E04D 13/0459 52/97
2008/0256813 A1 * 10/2008 Merryfield ..... B44D 3/38 33/414
2009/0282751 A1 * 11/2009 Orfield ..... E04F 13/0864 52/105
2012/0233933 A1 * 9/2012 Rasmussen ..... E04D 13/0459 52/58
2013/0055651 A1 * 3/2013 Garcia ..... E04D 13/15 52/58
2016/0340903 A1 * 11/2016 Folkersen ..... E04D 1/26
2017/0081854 A1 3/2017 Folkersen
2017/0145697 A1 * 5/2017 Anthony ..... E04D 13/0727
2018/0209152 A1 * 7/2018 Heo ..... E04D 13/0459
2018/0209153 A1 * 7/2018 Heo ..... E04D 13/155
2018/0223537 A1 * 8/2018 Bredeweg ..... E04D 13/0459
2018/0266115 A1 * 9/2018 Dye ..... E04D 13/0459
2019/0071873 A1 * 3/2019 Dye ..... B21D 5/16

* cited by examiner

FIELD SHINGLE LAYOUT MARKS ON ROOF DRIP EDGE

RELATED APPLICATIONS

This application claims the benefit of U.S. Provisional Application No. 62/515,817, filed Jun. 6, 2017. This application is herein incorporated by reference in its entirety for all purposes.

FIELD OF THE INVENTION

The invention relates to roofing, and, more particularly, to a roof drip edge having layout marks useful, at least, for alignment of metal and asphalt shingles and to assist in nail placement in relation to shingle layout.

BACKGROUND OF THE INVENTION

Obtaining the proper reveal to the weather of shingles during installation is critical to the performance and aesthetics of the completed system. This is currently most commonly accomplished using marks placed onto the roof underlayment, typically along the rake edges, and connecting these marks across the field section of the roof using a chalk line (i.e. "snapping a line"). The top, or head lap section, of the shingle is then installed along this line to ensure straight coursing of shingles.

The use of drip edges is commonplace on sloped roof applications, where they are typically installed along rakes and eaves. Drip edges are most often fabricated using five to eight inch rough stock metals and come in ten foot lengths. These drip edge profiles overhang the trim and vary from region to region, depending primarily on performance and aesthetic requirements; however, all drip edges come with a nail flange, which is used to attach the drip edge to the roof surface.

The installation of drip edges along the roof perimeter is accomplished using fasteners, which are installed at a specific rate, depending on local conditions, code requirements and manufacturer specifications. On asphalt shingle installations, manufacturers will call out for a specific shingle reveal to the weather, which, for metric shingles, is 5⅝" and, for standard shingles, is 5". On some metal shingle applications, it is not uncommon to see 8½" or greater shingle reveal to the weather. These reveals must be maintained to ensure an aesthetically pleasing and high quality (i.e. "warranty-worthy") roofing system. In addition, on metal roof applications, shingles have very specific interlocking requirements; a roof that is not laid out correctly is prone to wind failure and panel to panel paint finish inconsistencies.

When laying out field shingle reveals to the weather, it is typical for a roofer to use a tape measure and to place marks onto the roof underlayment along the rake, extending the marks from the eave towards the ridge of the roof. These marks are used to strike a line from rake to rake, onto which the top, or head lap, portion of a shingle is placed, thereby providing for straight shingle coursing. In addition to a standard tape measure, a roof layout tape and method of use is disclosed by Medford in U.S. Pat. No. 6,523,275B2. The use of the techniques taught by Medford or a standard tape measure using known techniques, however, results in substantially the same set of issues.

When using a tape measure it is typical to mark the location of the top of the shingle head lap using a lumber crayon. A lumber crayon easily marks roofing underlayments, such as tar paper or self-adhesive products. A lumber crayon, however, places a wide mark, making a specific point on the mark difficult to locate. In addition, these marks tend to be angled relative to the rake edge, as opposed to coming off square, making a specific point on the mark still more difficult to assess. When marking with another device, it becomes difficult to see the mark as the sun heats the underlayment, reducing the contrast between the mark and background on which it is set. Furthermore, as the underlayment heats up or gets exposed to moisture, it has a tendency to buckle, thereby elevating the mark from the flat plane of the substrate, making the mark even less accurate.

The drip edge itself is difficult to mark and will not accept a mark from a lumber crayon, due to the waxy nature of the crayon. As such, marks are typically placed onto the underlayment approximately twelve-eighteen inches from the rake edge. Therefore, any deviation in marks is magnified, in relation to other marks, once a line is struck from rake edge to rake edge. These deviations can become substantial, especially when working on steep slopes, due to the angle at which the roofer is looking at the tape measure, which results in a parallax effect that causes the mark to be inaccurate.

As the work progresses up the roof slope, a tape measure hook or catch may be placed onto recently created marks that are no longer at the desired location. Any movement of the hook or catch, which is placed onto a mark in the field of the roof layout, magnifies any marking inaccuracies.

Furthermore, the installation of roofing is heavy work and often requires larger crews, with each roofer marking the work from a different perspective and holding the chalk line at various locations on the marks, the potential for further measuring and marking issues is high. The introduction of numerous human variables creates slight errors from mark to mark, magnifying existing errors.

In addition to a tape measure, Hungarter, in U.S. Pat. No. 6,511,741B1 discloses roofing tape that is consumed during installation. The use of this product does not address underlayment elevation from the flat plane of the substrate, which is caused by moisture and other variables affecting the underlayment onto which the roof tape is installed. This underlayment elevation and the flexibility of the roof tape itself cause the connecting of the marks placed using the roof tape to vary from a straight line. In addition, this product requires the purchase and bringing onto the roof top additional material and adds steps to the roofing process (i.e. the installation of the consumable tape).

In yet another example, Folkersen in application U.S. Ser. No. 15/365,201 discloses a starter shingle with layout capability. In Folkersen, starter shingles don't always run true due to the malleability of shingles as they follow the rake line. On older construction, and even some new construction work, the rake line is not always a straight line from eave to ridge.

Furthermore, it has been discovered that, in some regions, a starter shingle is not used at the rake and the shingle layout benefit is not an option.

Therefore what is needed is a way to layout out a roof without the use of a tape measure, starter shingles, or roof tapes.

SUMMARY OF THE INVENTION

The International Building Code (IBC) states "A drip edge shall be provided at eaves and gables of shingle roofs". Because drip edges are required at these interfaces, the inclusion of markings thereon requires no additional roofing-related products or steps while allowing for an installer to easily create the required layout marks. Metal, which is most often used in drip edge construction is also less prone to deviate from a straight line along the rake, regardless of rake trim irregularity, ensuring the accuracy of the markings printed thereon that are extended out through the field section of a roof.

It is hereby disclosed that marks that provide for a specific field shingle reveal to the weather and/or specific field shingle side-lap is accomplished by placing marks directly on rake and eave drip edges. When using drip edges in accordance with embodiments of the present disclosure, the roofer no longer needs to measure for a specific shingle layout to complete the installation or bring additional materials onto the roof. In addition, the marks can assist the roofer, especially if the roofer is working alone, by using nails placed into specific layout marks to hold one end of the line. Furthermore, the rake edge drip edge can overhang the eave drip edge thereby providing a gauge for field shingle overhang at the eave, while using the drip edge layout marks.

One embodiment of the present disclosure provides a drip edge, the drip edge comprising: flashing configured in the form of a drip edge and having an upper face designed to be visible and upwards-facing upon installation onto a roof; wherein the flashing further is rectangular in shape, having two sets of opposing, parallel edges of equal length wherein adjacent sides are unequal in length, with one set of edges shorter than the other, wherein the flashing further comprises two joining marks, each running parallel to and positioned at the same distance from opposing shorter edges of the flashing, wherein the flashing further comprises a plurality of equally-spaced field shingle layout markings on the upper face, with the spacing measured from a first joining mark parallel to the longer set of edges of the flashing, the field shingle layout markings oriented parallel to the opposing shorter edges of the flashing, and wherein the distance between joining marks is evenly divisible by the number of field shingle layout marks on the upper face of the flashing, resulting in a first field shingle layout mark and a final field shingle layout mark being co-located with the joining marks.

Another embodiment of the present disclosure provides such a drip edge, the flashing further comprising a plurality of secondary field shingle layout markings on the upper face, each secondary field shingle layout marking being adjacent the field shingle layout markings, wherein each field shingle layout marking is bordered by at least two secondary field shingle layout markings, with equal numbers of secondary field shingle layout markings on either side of the field shingle layout markings, each secondary field shingle marking on either side of the field shingle layout marking being equidistant from the corresponding secondary field shingle layout marking on the opposite side of the field shingle layout marking.

A further embodiment of the present disclosure provides such a drip edge wherein the upper face further comprises a nail flange containing markings indicating appropriate nailing locations.

Yet another embodiment of the present disclosure provides such a drip edge wherein the markings are selected from the group consisting of lines, dots, divots, indentations, and grooves.

A yet further embodiment of the present disclosure provides such a drip edge wherein a first and last the marking is positioned at 2" in from left-most and right-most edges of the upper face, respectively, and a plurality of markings are repeated every 5⅝", beginning at the first marking, along substantially the entire length of the drip edge.

Still another embodiment of the present disclosure provides such a drip edge wherein the drip edge is 122.125" long.

A still further embodiment of the present disclosure provides such a drip edge further comprising a chalk line holder positioned adjacent each the marking.

Even another embodiment of the present disclosure provides such a drip edge wherein the chalk line holder comprises an indentation into which a chalk line clasp may be hooked.

An even further embodiment of the present disclosure provides such a drip edge wherein a first and last the marking is positioned at 2" in from left-most and right-most edges of the upper face, respectively, and a plurality of markings are repeated every 5", beginning at the first marking, along substantially the entire length of the drip edge.

A still even another embodiment of the present disclosure provides such a drip edge wherein the drip edge is 119" long.

A still even further embodiment of the present disclosure provides such a drip edge further comprising a chalk line holder positioned adjacent each the marking.

Still yet another embodiment of the present disclosure provides such a drip edge wherein the chalk line holder comprises an indentation into which a chalk line clasp may be hooked.

One embodiment of the present disclosure provides a method of creating layout marks extending across the field of a roof, the method comprising: installing a drip edge with a longer edge thereof positioned adjacent and parallel to an edge of an eave of a roof; installing subsequent drip edges across the eave, wherein a first joining mark of each subsequent drip edge is aligned with a final joining mark of a previous drip edge; installing a drip edge with a longer edge thereof positioned adjacent and parallel to an edge of a rake; installing subsequent drip edges across the rake, wherein a first joining mark of each subsequent drip edge is aligned with a final joining mark of a previous drip edge; repeating the installing of drip edges in accordance with the above steps on an opposite rake; and creating a template for field shingle layout by drawing a line between opposing field shingle layout markings.

Another embodiment of the present disclosure provides such a method of creating layout marks extending across the field of a roof wherein installing of drip edges comprises nailing nails through the markings on the nail flanges of the drip edges.

A further embodiment of the present disclosure provides such a method of creating layout marks extending across the field of a roof wherein the nails are first partially nailed through the markings on the nail flanges of the drip edges, leaving a portion of nail exposed, the method further comprising wrapping a line around a nail adjacent a corner of the roof, wrapping the line around a nail directly opposite the nail adjacent a corner of the roof, using the line as a guide to draw a line connecting the opposing field shingle layout markings, removing the line from the nails, and completing nailing of the nails.

Yet another embodiment of the present disclosure provides such a method of creating layout marks extending across the field of a roof further comprising installing underlayment over a drip edge positioned adjacent an eave of the roof prior to fastening drip edges to rakes of the roof, wherein the underlayment is underneath drip edges installed on the rakes following installation thereof.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 1:
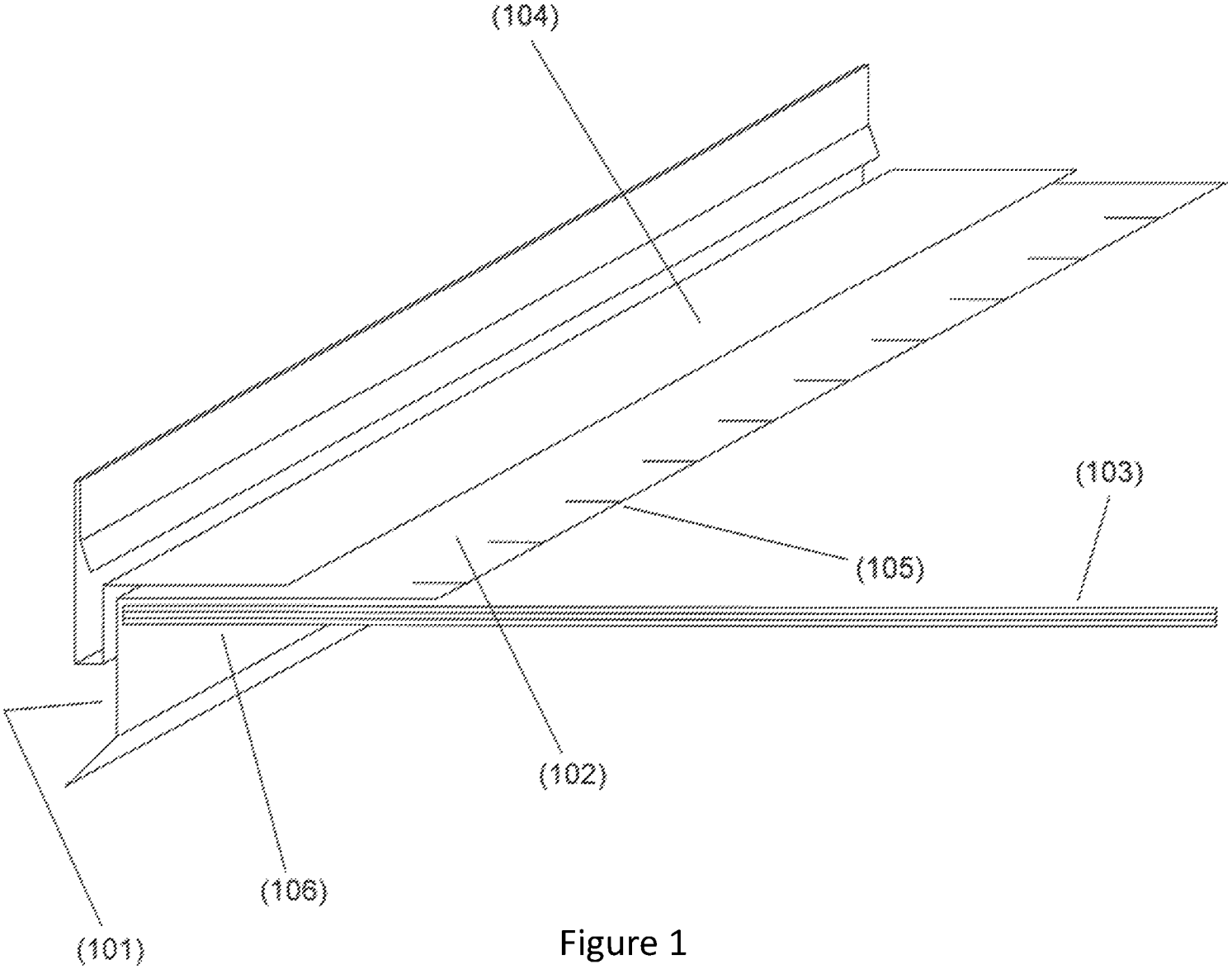
FIG. 1 is a left, upper perspective view of two drip edges used together, configured in accordance with embodiments of the present disclosure.

Now referring to FIG. 1, two drip edges that remove the need for a starter shingle while providing for a drip edge layout capability for roofing shingles are disclosed. The typical drip edge installed has an exposed face 101 and a nail flange 102 with the nail flange 102 extending onto the roof plane 103. In some instances it becomes beneficial to add a top metal drip edge 104 onto an underlying drip edge 106. This is often the case with second layer roof applications, where the second section of metal (the top drip edge) 104 is geared towards preventing shingle uplift due to wind by protecting the leading edge of the shingles. Our layout marks 105, in embodiments, are placed onto either the underlying 106 or top metal drip edge 104. The nail flange 102, along the rake edge, is installed onto the underlayment, thereby maintaining nail flange 102 visibility after the underlayment is installed.

Figure 2:
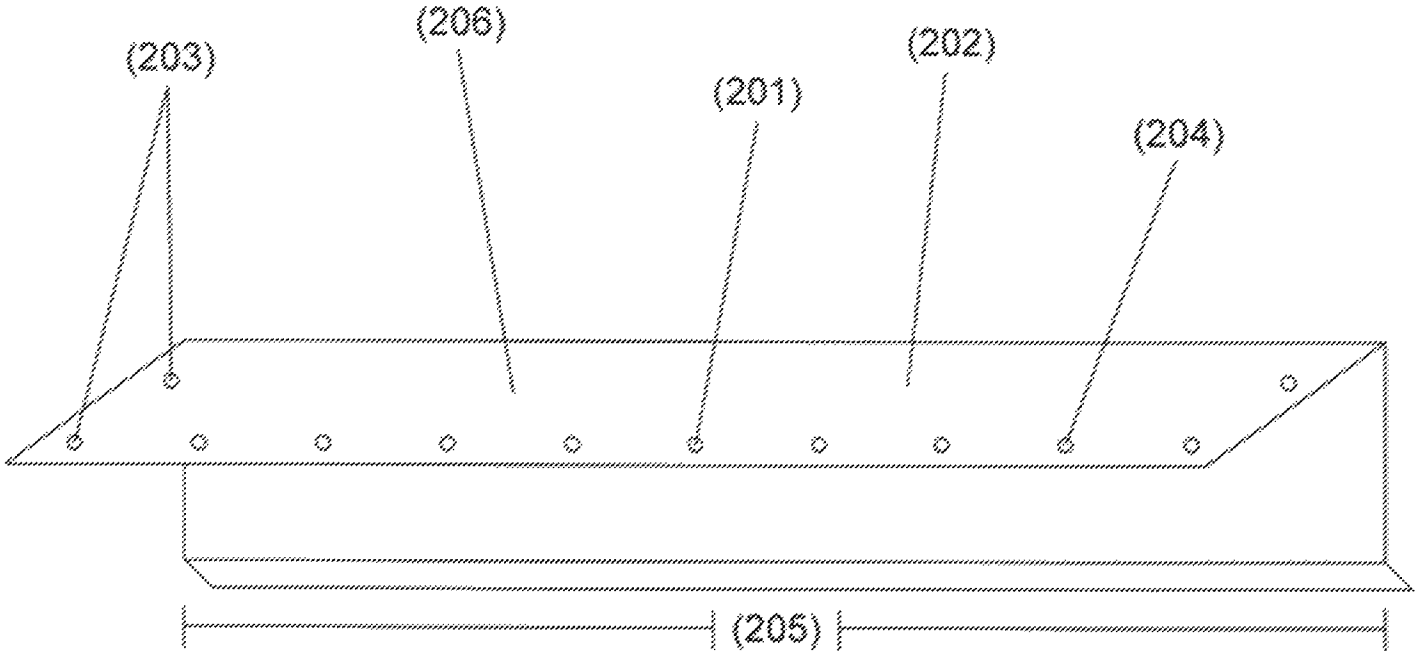
FIG. 2 is a front, upper perspective view of a drip edge configured in accordance with embodiments of the present disclosure.

Now referring to FIG. 2, another embodiment of the present disclosure is shown; this embodiment uses only a single section of drip edge. FIG. 2 discloses the placement of marks 201 onto the drip edge 206 nail flange 202, these marks being useful for aligning shingles. In embodiments, these marks 201 are lines, dots, divots, indentations, grooves or other markings, as would be known to one of ordinary skill in the art, placed across or onto the nail flange 201. These joining marks 203 are also useful for connecting sections of drip edge 206 while providing for proper drip edge 206 overlap, which is critical for maintaining proper shingle reveal capability from section to section of the drip edge 206. These marks 201 do not remain visible after completion of the finished roofing system, but provide a useful guideline during construction when installing the finished roofing material.

The International Building Code (IBC) requires two inch overlap of drip edge sections. When installing drip edges 206 along the rake, the drip edge 206 section closest to the eave is typically installed first, so as to provide for proper watershed from section to section. As the drip edge 206 is installed, the layout must be maintained from section to section. The majority of asphalt shingles installed in North America today are metric shingles that measure 13¼" wide. As such, the exact placement of marks 201 becomes critical to their usefulness.

As such, in embodiments, marks 201 are placed at the following increments 2", 7⅝" and 13¼" and adding 5⅝" thereafter to each mark 201, ending in a 2" increment. In embodiments, a length of drip edge section 205 is 122.125". This is slightly longer than the industry standard of ten feet, but this length of drip edge is preferred, in embodiments, due to the precise nature of the layout requirements. Using this length, the drip edge marks, in embodiments, comprise 21—5⅝" marks 201 between the 2" joining marks 203 at each end. The marks are placed at the following intervals 2", 7.625", 13.25", 18.875", 24.5", 30.125", 35.75", 41.375", 47", 52.625", 58.25", 63.875", 69.5", 75.125", 80.75", 86.375", 92", 97.625", 103.25", 108.875", 114.5", 120.125 and leaving 2" for section overlap.

The key to maintaining the proper shingle reveal pattern is to have the 2" joining marks 203 directly above each other when installed. Once again, keeping in mind that a smaller drip edge overlap is possible with changes in mark 201 locations relative to the end of the drip edge. In some situations, the notching of drip edges in lieu joining marks 203 may be used to provide for proper mark 201 spacing from drip edge section to drip edge section. These joining marks 203 now become additional marks 201 required for shingle layout requirements.

Furthermore, the manufacturing of shingles is not a perfect art and, with the onset of laminate, dimensional or as commonly known "architectural" shingles, the exposed laminate is not always on the same plane at the nose, as the underlying shingle. This irregularity may be compensated for with a correction course of shingles, which is less than 5⅝", as such, embodiments build such a correction course or courses into a regular ten foot length of drip edge, thereby maintaining industry norms for drip edge length.

In another embodiment, when installing standard shingles which are 12" wide and require 5" exposure to the weather the marks 201 on the drip edge would be placed at a different increment on the drip edge flange. As such, the 2" joining marks 203 and marks 201 are placed onto a 119" long drip edge section with 23—5" marks 201 between the two joining marks 203.

When installing a drip edge from an eave towards a ridge, there is a tendency for the top of the drip edge, which extends towards the ridge, to pull away from the rake edge. On steeply pitched roofs, the roofer can only reach so high without installing another row of staging, which makes no sense without the shingles already having been installed. The use of joining marks 203 in accordance with embodiments allows for the squaring of the drip edge to the underlying drip edge and rake. This eliminates adding additional brackets, on steep slope applications, in order to fasten the drip edge prior to getting to that point in the installation.

Figure 3:
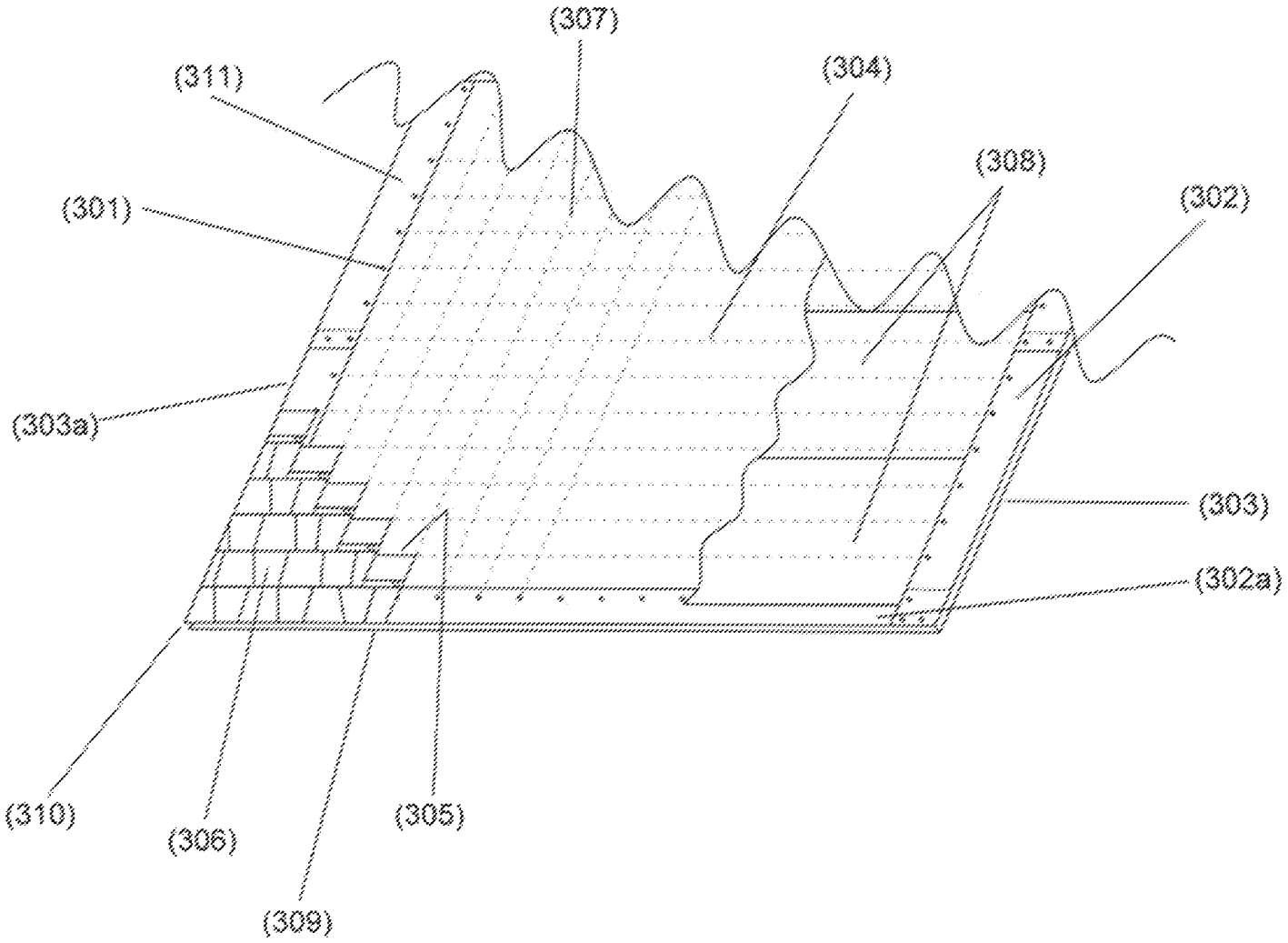
FIG. 3 is a front, upper perspective view of a roof incorporating drip edges configured in accordance with embodiments of the present disclosure.

Now referring to FIG. 3, marks 301 are placed onto a drip edge 302 and connected with lines 304 from rake 303 to rake 303*a*. These lines 304 permit the head lap portion 305 of shingles 306 to be installed in a straight line 304 from rake 303 to rake 303*a*. The rake 303 to rake 303*a* lines tend to be more critical than bond lines 307, but, depending on the shingle 306 being installed, bond lines 307 can also be created using the drip edge 302 marks 301 of embodiments as a guide. In embodiments, additional marks are placed on the drip edges adjacent the primary marks 301. These lines are useful where the roof is not completely flat or the lines

304 otherwise require slight adjustment, allowing the roof installer to remain consistent without resorting to external measurement devices.

One example where bond lines 307 may be required is when installing three tab shingles, where proper water pour (the cut out on three tab shingles) alignment affects both performance and the look of the completed roofing system.

In embodiments, the rake edge drip edge 302 marks 301 need to remain visible during the installation phase of the work. As such, in embodiments, the eave drip edge 302*a* is installed first and the underlayment 308 then installed onto the nail flange of the eave drip edge 302*a*. Once the underlayment 308 has been installed, the rake edge drip edge 302 is installed onto and over the underlayment 308 exposing the layout marks 301 placed onto the drip edge 302. Furthermore, field shingles 306 are installed with an overhang along the eave. Once the eave drip edge 302*a* has been installed, the rake edge drip edge 302 should be installed overhanging the nose 309 of the eave drip edge 302*a* by the desired field shingle 306 overhang. Now, when marks 301 are used to strike a line 304 from rake 303 to rake 303*a* and the top of the head lap 305 of the shingle 306 is installed onto the mark 301, the first course of shingles 306 has a consistent overhang along the eave. This supports the underside of the field shingle 306 at a critical junction of the eave and rake interface 310 with metal, adding strength to a potential critical failure point. Furthermore, the system of joining the eave 302*a* and the rake 302 drip edge has been considered and any adjustment or mitering of the drip edge is below the nail flange 311 marks 301; the marks 301 are not impacted by the eave/rake interface 310 mitering of the eave 302*a* and rake drip edges 302.

Figure 4:
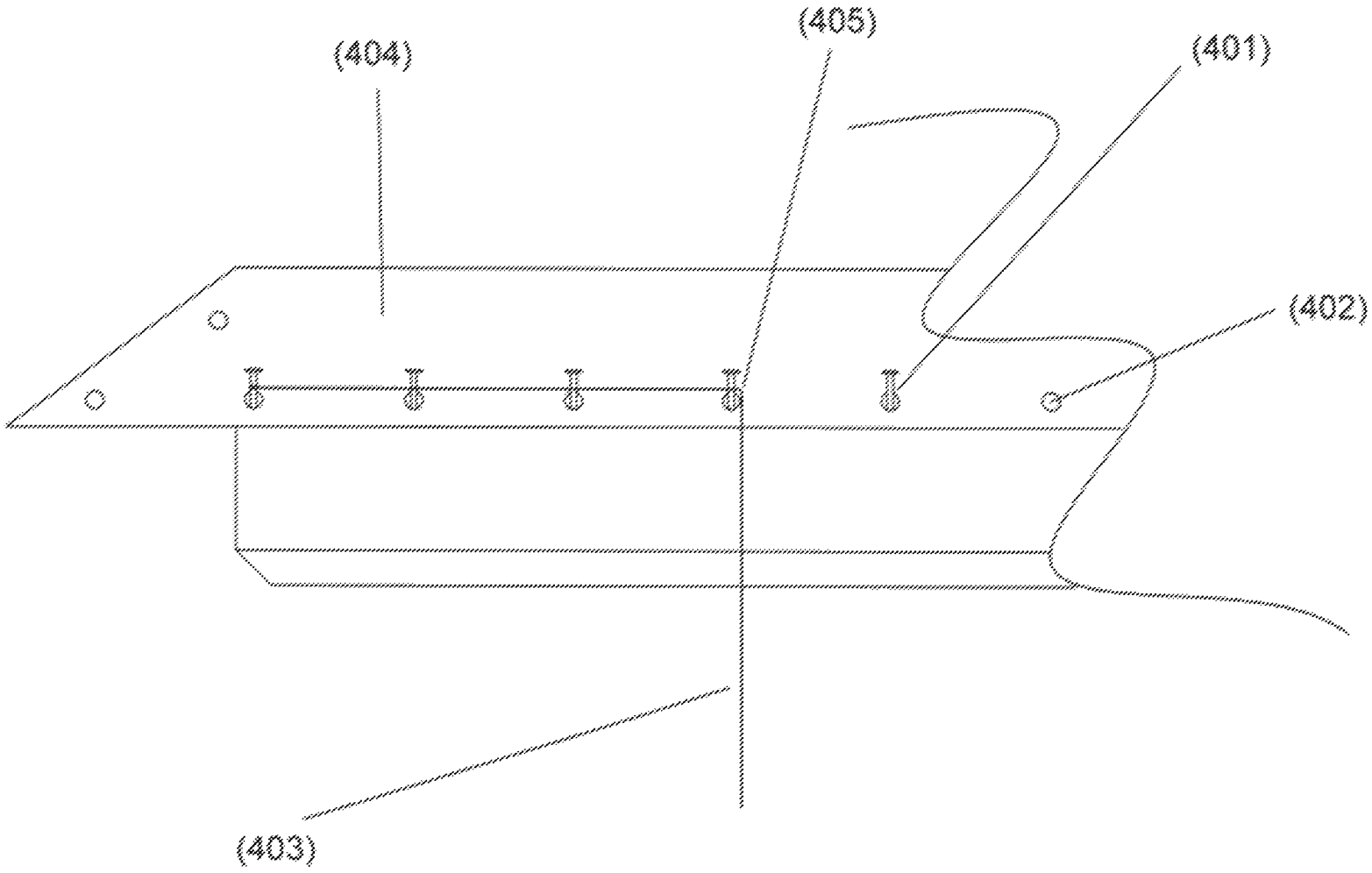
FIG. 4 is a front, upper perspective view of a drip edge configured in accordance with embodiments of the present disclosure.

Now referring to FIG. 4, we disclose the placement of elevated nails 401 driven partially into the marks 402. These elevated nails 401 serve the purpose of holding the end of the line 403 without the assistance of another roofer. Once these partially driven or elevated nails 401 have been utilized to strike a line 403 they can be driven into place to hold the drip edge 404 in place. It has been found that a mark 402 in the form of a divot in metal roof applications provides for a specific point where a screw (as required for metal applications) can rotate, thereby, preventing wandering across the metal of the screw when starting the screw installation.

These partially driven or elevated nails 401 provide the ability for the roofer to simply leave the line attached to a single nail and loop 405 the line 403 onto another nail and strike that line. Continuing this process up the rake edge of the roof without disconnecting the line 403 each time a line 403 was struck. Once the line 403 is struck, the line 403 can be removed and the nail driven in holding the drip edge 404 in place at very specific locations.

Figure 5:
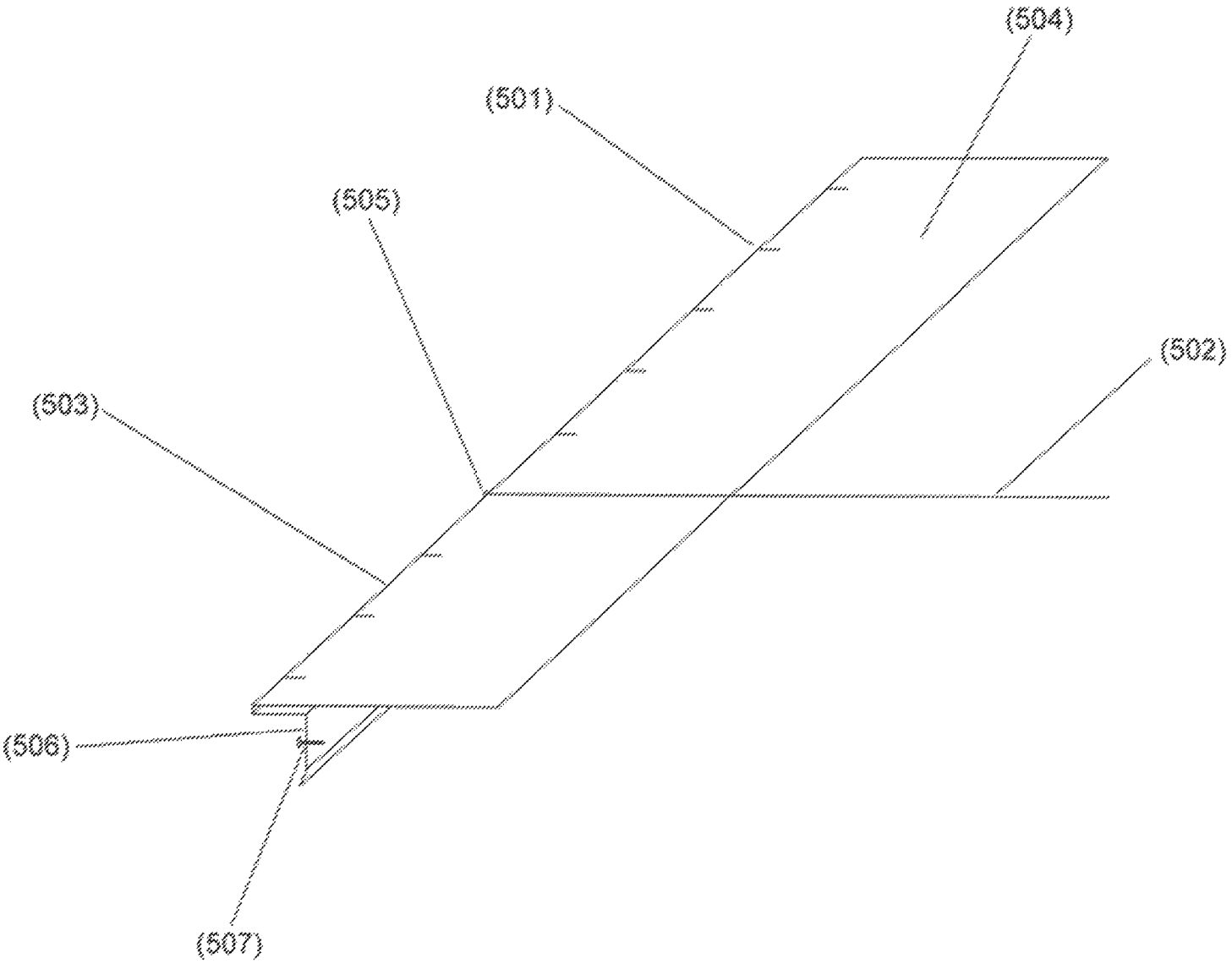
FIG. 5 is a front, upper, left side perspective view of a drip edge configured in accordance with embodiments of the present disclosure.

Now referring to FIG. 5, we disclose the placement of shingle layout marks 501 capable of holding the end of a chalk line 502, eliminating the need for elevated nails. These marks 501, in embodiments, are placed along the nose 503 of the drip edge 504 as indentations into which the clasp 505 at the end of the chalk line 502 hooks into the marks 501. In embodiments, it is advantageous to secure the underlying drip edge 504 face 506, which gets covered by a subsequent drip edge 504 section, with a box nail 507 to prevent the drip edge 504 from pulling up from the trim board when striking a line 502. When using heavier gauge metals, such as 26 gauge or 0.032" aluminum, the box nail 507 may not be required due to the firmness of the metals used.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A system, comprising:

a plurality of drip edges, each said drip edge comprising:

flashing configured to lay flat on a roof following installation, wherein said flashing is rectangular in shape and comprises a plurality of equally-laterally-spaced and longitudinally-oriented primary markings and a plurality of secondary markings, each secondary marking positioned adjacent to a respective said primary marking, wherein a first and last of the plurality of the primary markings are positioned an equal distance from opposing shorter edges of said flashing, wherein said primary markings are oriented parallel to the opposing shorter edges of said flashing, wherein said primary markings are configured to remain visible following initial installation of said drip edge on the roof, until covered by a course of shingles, wherein the primary markings do not penetrate fully through the flashing, and wherein, in an installed configuration, said drip edge is configured such that the drip edge is installed with a longer edge thereof positioned adjacent and parallel to an edge of an eave of the roof and subsequent drip edges are installed across said eave, with the first primary marking of each subsequent drip edge being aligned with a final primary marking of the previous drip edge and an additional course of drip edges is installed with a longer edge thereof positioned adjacent and parallel to an edge of a rake with subsequent drip edges are installed across said rake, with the first primary marking of each subsequent drip edge being aligned with the final primary marking of a previous drip edge, the marking of connections between primary markings creates a grid that provides shingle layout.

2. The system of claim 1 wherein each primary marking is bordered by at least two secondary markings, with equal numbers of secondary markings on either side of said primary markings, each secondary marking on either side of said primary marking being equidistant from the corresponding secondary marking on the opposite side of said primary marking.

3. The system of claim 1 wherein said drip edge further comprises a nail flange containing nail markings indicating appropriate nailing locations.

4. The system of edge of claim 1 wherein said primary markings are selected from the group consisting of lines, dots, divots, indentations, and grooves.

5. The system of claim 1 wherein said flashing further comprises a chalk line holder positioned adjacent each said primary marking.

6. The drip edge of claim 5 wherein said chalk line holder comprises an indentation configured to retain a chalk line clasp.

7. The system of claim 1 wherein said first and last of the plurality of primary markings are positioned at 2" in from the opposing shorter edges of said flashing, respectively, with the remainder of the plurality of primary markings being disposed every 5⅝", starting from said first of the plurality of primary markings, along substantially the entire length of the drip edge.

8. The system of claim 7 wherein said drip edge is 122.125" long.

9. The drip edge of claim 1 wherein the first and last of the plurality of primary markings are positioned at 2" in from the opposing shorter edges of said flashing, with the remainder of the plurality of primary markings being disposed every 5", starting from said first of the plurality of primary markings, along substantially the entire length of the drip edge.

10. The drip edge of claim 9 wherein said drip edge is 119" long.

11. A method of creating layout marks extending across the field of a roof, the method comprising:

using the system of drip edges in accordance with claim 3:

installing a drip edge with a longer edge thereof positioned adjacent and parallel to an edge of an eave of a roof;

installing subsequent drip edges across said eave, wherein a first joining mark of each subsequent drip edge is aligned with a final joining mark of a previous drip edge;

installing a drip edge with a longer edge thereof positioned adjacent and parallel to an edge of a rake;

installing subsequent drip edges across said rake, wherein a first joining mark of each subsequent drip edge is aligned with a final joining mark of a previous drip edge;

repeating the installing of drip edges in accordance with the above steps on an opposite rake; and creating a template for field shingle layout by drawing a line between opposing field shingle layout markings.

12. The method of creating layout marks extending across the field of a roof of claim 11 further comprising installing underlayment over a drip edge positioned adjacent an eave of the roof prior to fastening drip edges to rakes of the roof, wherein the underlayment is underneath drip edges installed on the rakes following installation thereof.

13. The method of creating layout marks extending across the field of a roof of claim 11 wherein installing of drip edges comprises nailing nails through the markings on said nail flanges of said drip edges.

14. The method of creating layout marks extending across the field of a roof of claim 13 wherein said nails are first partially nailed through the markings on said nail flanges of said drip edges, leaving a portion of nail exposed, the method further comprising wrapping a line around a nail adjacent a corner of the roof, wrapping said line around a nail directly opposite the nail adjacent a corner of the roof, using said line as a guide to draw a line connecting the opposing field shingle layout markings, removing the line from said nails, and completing nailing of the nails.

15. A method of creating layout marks extending across the field of a roof, the method comprising:

using the system of drip edges in accordance with claim 6:

installing a drip edge with a longer edge thereof positioned adjacent and parallel to an edge of an eave of a roof;

installing subsequent drip edges across said eave, wherein a first joining mark of each subsequent drip edge is aligned with a final joining mark of a previous drip edge;

installing a drip edge with a longer edge thereof positioned adjacent and parallel to an edge of a rake;

installing subsequent drip edges across said rake, wherein a first joining mark of each subsequent drip edge is aligned with a final joining mark of a previous drip edge;

repeating the installing of drip edges in accordance with the above steps on an opposite rake; and creating a template for field shingle layout by drawing a line between opposing field shingle layout markings.

16. The method of creating layout marks extending across the field of a roof of claim 15 wherein the step of creating a template for field shingle layout comprises inserting a line in an indentation corresponding with a field shingle layout mark, thereby securing the line thereto, inserting said line in an indentation directly opposite the first indentation, using said line as a guide, drawing a line connecting the opposing field shingle layout markings, and removing the line from said indentations.

17. A method of creating layout marks extending across the field of a roof, the method comprising:

using the system of drip edges in accordance with claim 8:

installing a drip edge with a longer edge thereof positioned adjacent and parallel to an edge of an eave of a roof;

installing subsequent drip edges across said eave, wherein a first joining mark of each subsequent drip edge is aligned with a final joining mark of a previous drip edge;

installing a drip edge with a longer edge thereof positioned adjacent and parallel to an edge of a rake;

installing subsequent drip edges across said rake, wherein a first joining mark of each subsequent drip edge is aligned with a final joining mark of a previous drip edge;

repeating the installing of drip edges in accordance with the above steps on an opposite rake; and creating a template for field shingle layout by drawing a line between opposing field shingle layout markings.

18. A method of creating layout marks extending across the field of a roof, the method comprising:

system of drip edges drip edge of claim 10:

installing a drip edge with a longer edge thereof positioned adjacent and parallel to an edge of an eave of a roof;

installing subsequent drip edges across said eave, wherein a first joining mark of each subsequent drip edge is aligned with a final joining mark of a previous drip edge;

installing a drip edge, with a longer edge thereof positioned adjacent and parallel to an edge of a rake;

installing subsequent drip edges across said rake, wherein a first joining mark of each subsequent drip edge is aligned with a final joining mark of a previous drip edge;

repeating the installing of drip edges in accordance with the above steps on an opposite rake; and creating a template for field shingle layout by drawing a line between opposing field shingle layout markings.

* * * * *